US005392097A

United States Patent [19]

Ohtani

[11] Patent Number: 5,392,097

[45] Date of Patent: Feb. 21, 1995

[54] IMAGE PROCESSING APPARATUS

[75] Inventor: Kazuo Ohtani, Kodaira, Japan

[73] Assignee: Canon Kabushiki Kaisha, Tokyo, Japan

[21] Appl. No.: 946,020

[22] Filed: Sep. 15, 1992

Related U.S. Application Data

[63] Continuation of Ser. No. 664,611, Mar. 4, 1991, abandoned.

[30] Foreign Application Priority Data

Mar. 6, 1990 [JP] Japan ..... 2-52649

[51] Int. Cl.[6] ..... G03G 21/00

[52] U.S. Cl. ..... 355/214; 355/204; 355/208

[58] Field of Search ..... 355/204, 208, 209, 214, 355/228, 229

[56] References Cited

U.S. PATENT DOCUMENTS 4,755,852 7/1988 Fujita .
4,982,232 1/1991 Naito ..... 355/208

FOREIGN PATENT DOCUMENTS 55446 3/1984 Japan .
60-37570 2/1985 Japan .
114883 6/1985 Japan ..... 355/209
60-257458 12/1985 Japan .
63-135961 6/1988 Japan .
240573 10/1988 Japan .
261374 10/1988 Japan .
269950 10/1989 Japan .
269951 10/1989 Japan .

*Primary Examiner*—Benjamin R. Fuller
*Assistant Examiner*—John Barlow
*Attorney, Agent, or Firm*—Fitzpatrick, Cella, Harper & Scinto

[57] ABSTRACT

An image processing apparatus includes a sensor for sensing image density of an original, a determining unit for determining an image processing condition corresponding to image density sensed by the sensor, based on a parameter, a setting unit for setting a desired image processing condition, a processor for processing an original image under an image processing condition determined by the determining unit or under an image processing condition set by the setting unit, and a modifying unit for modifying the parameter in accordance with the image density sensed by the sensor means and image processing condition set by the setting means.

10 Claims, 5 Drawing Sheets

IMAGE PROCESSING APPARATUS

This application is a continuation of application Ser. No. 07/664,611, filed Mar. 4, 1991, now abandoned.

BACKGROUND OF THE INVENTION

1. Field of the Invention

This invention relates to image processing apparatuses such as copiers and printers.

2. Related Background Art

An image forming apparatus of the pertaining type, a copier for copying original images on paper or like sheet, is well known in the art.

Such a copier is provided with an automatic density regulation function for obtaining a copy of an image of a constant density regardless of the density of the original image. For automatic density regulation, original scanning is effected to the density of an original prior to image formation (the scanning being hereinafter referred to as photometric scan). At this time, a control unit calculates original exposure lamp "on" voltage or the like according to original density data obtained by a density sensor. With the lamp held "on" using the "on" voltage, original scanning is effected for printing by irradiating a photosensitive drum with reflected light from the original (the scanning being hereinafter referred to as exposure scan). Subsequently, printing is effected using a well-known process of electrophotography.

For a control unit noted above, a microcomputer is used extensively.

The microcomputer in the control unit usually includes a ROM, which contains relation between density data and corresponding adequate lamp voltages. Thus, the optimum lamp voltage is determined from the density data.

In such prior art, the "relation between density data and adequate lamp voltage" is always given by a fixed curve. However, the relationship between density data and adequate lamp voltage can vary over time due to photosensitive drum sensitivity changes, density sensor sensitivity changes, or lamp illumination intensity changes.

For example, if the photosensitivity drum sensitivity is reduced, with the same original, i.e., with the same density data it is impossible to obtain a print image of adequate density unless the lamp voltage level is increased.

SUMMARY OF THE INVENTION

The present invention has been intended in light of the above, and seeks to provide an image processing apparatus that permits adequate image processing with regard to environment changes, such as ambient temperature changes.

Another object of the invention is to provide an image processing apparatus, which permits automatic image processing to be performed adequately in accordance with the original image density.

It is a further object of the invention to provide an image processing apparatus, which permits automatic image processing under an image processing condition instructed by the operator.

The above and other objects and effects of the invention will become more apparent from the following description.

DETAILED DESCRIPTION OF THE PREFERRED EMBODIMENTS

Figure 1:
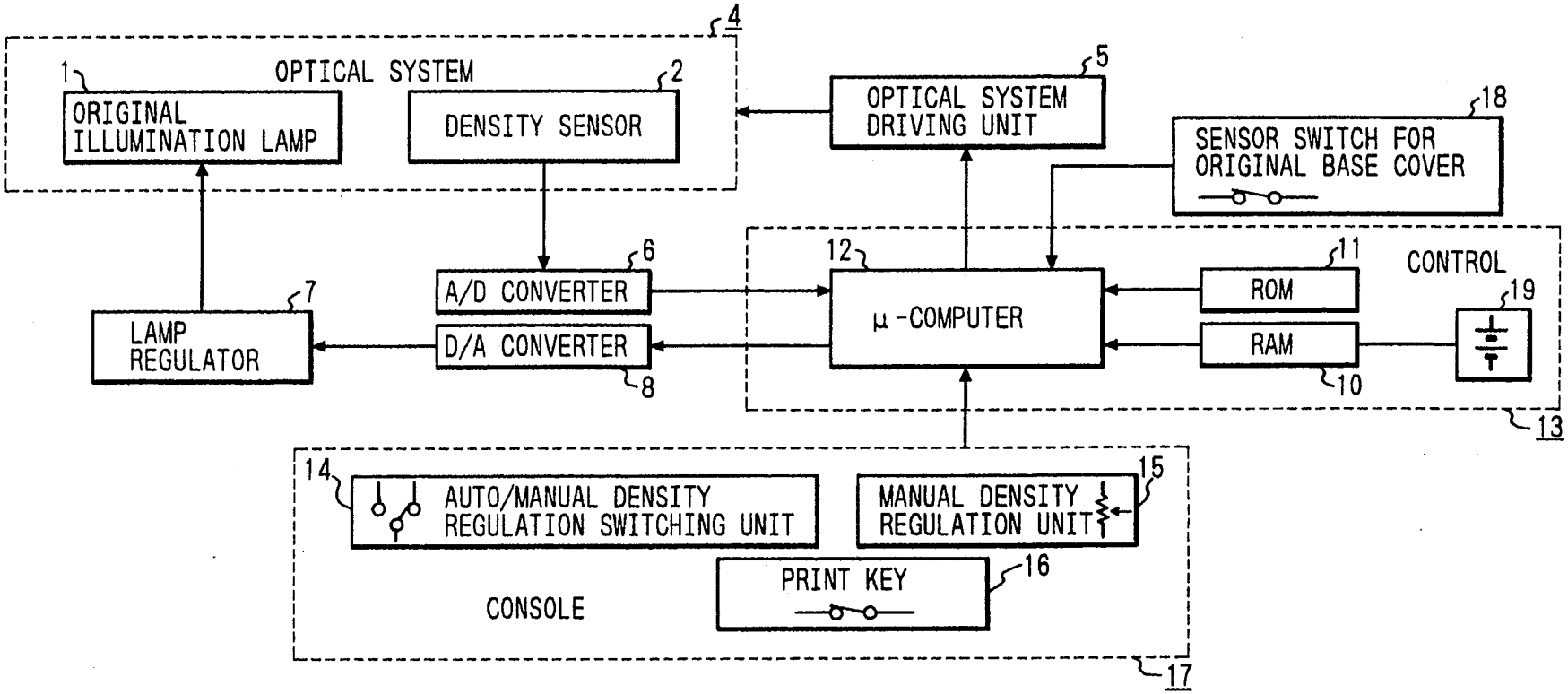
FIG. 1 is a block diagram showing an embodiment of the invention.
Figure 2:
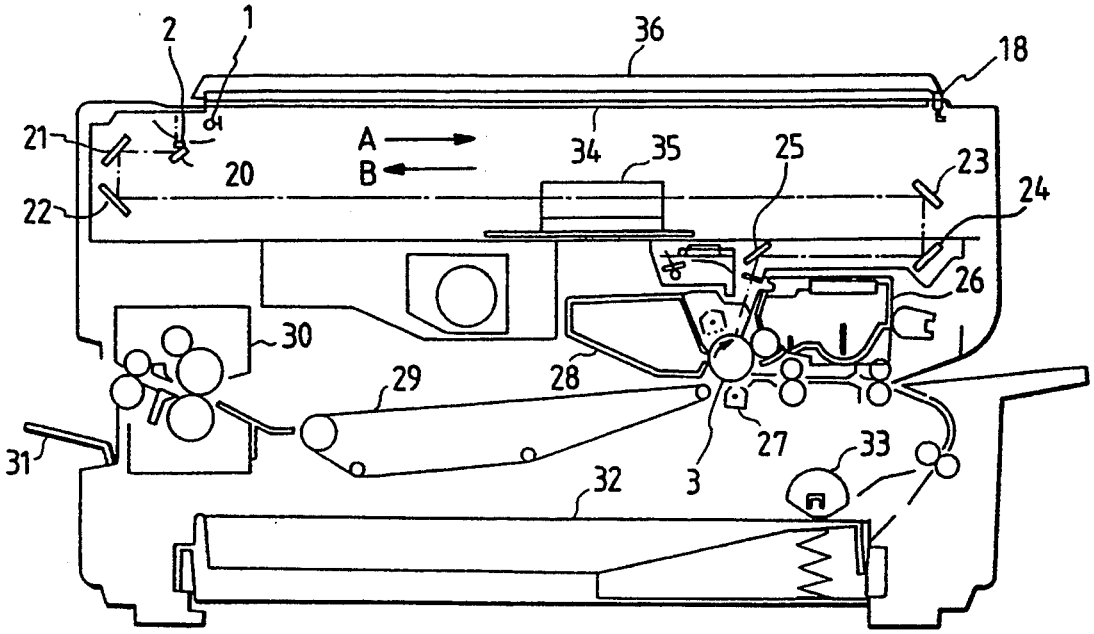
FIG. 2 is a schematic sectional view showing the embodiment shown in FIG. 1.
Figure 3:
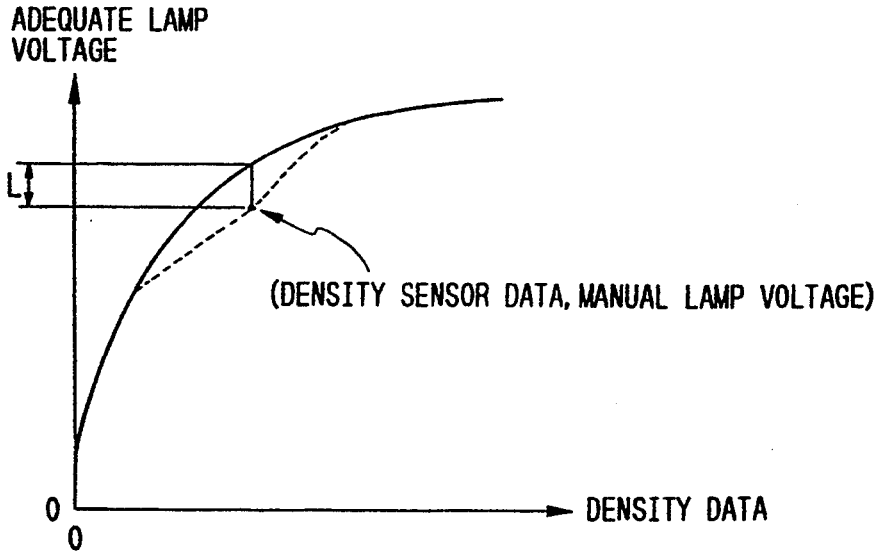
FIG. 3 is a graph for explaining the operation of one embodiment of the invention.
Figure 4:
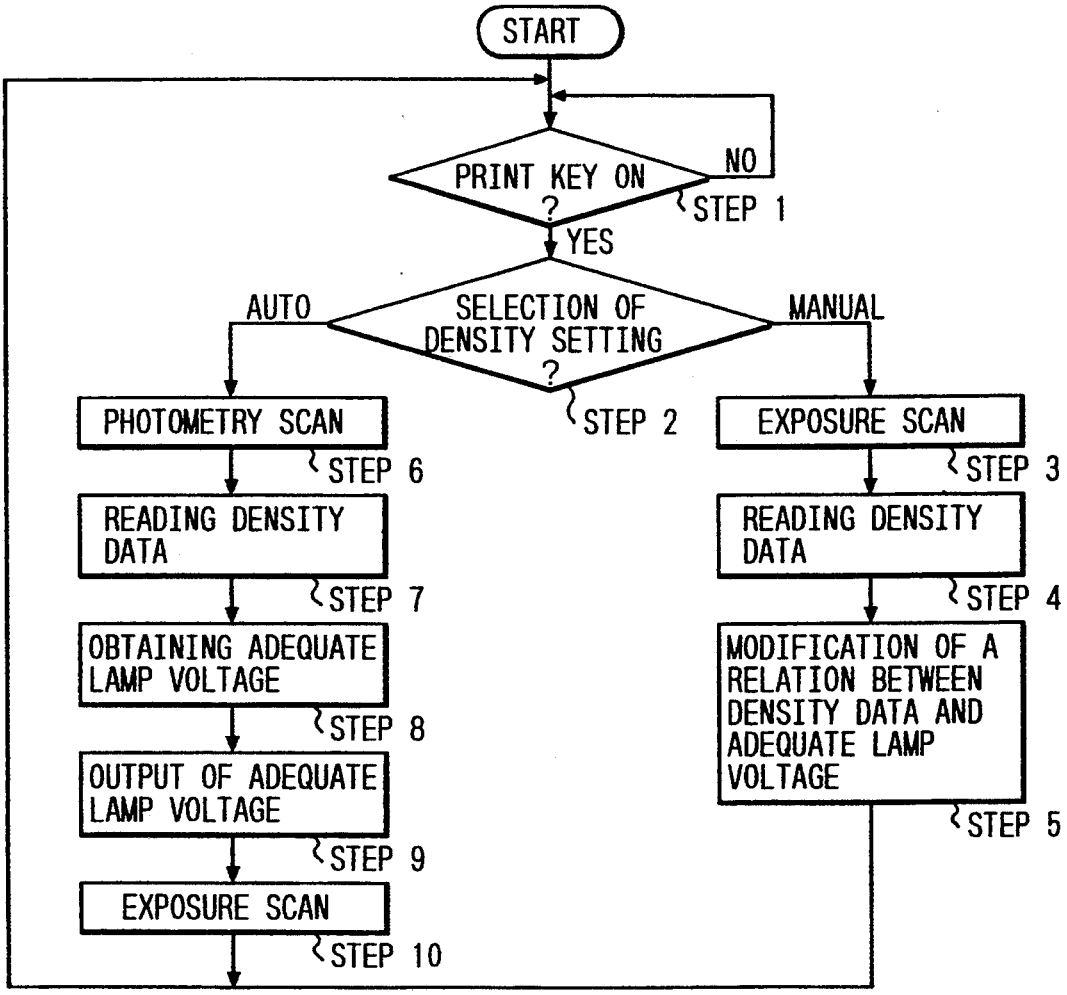
FIGS. 4 to 6 are flow charts illustrating control procedures in respective embodiments of the invention.

FIGS. 1 and 2 are a block diagram and a schematic sectional view showing a copier incorporating the invention, and FIGS. 3 and 4 are a graph and a flow chart illustrating an operation concerning exposure regulation after depression of print key 16, shown in FIG. 1, in one embodiment of the invention.

Referring to FIG. 2, designated at 34 is an original base glass, at 1 is an original on original base glass 34, and at 2 is a density sensor for detecting the image density of the original according to light reflected therefrom. Mirrors 20 to 25 and lens 35 lead light reflected from the original to photosensitive drum 3. Lamp 1 and mirrors 20 to 22 scan and expose the original with their forward movement in the direction of arrow A, and after the end of exposure they are moved backwards in the direction of arrow B. Designated at 36 is an original cover, and at 18 a cover sensor switch for detecting that an original base cover is in a closed state.

Photosensitive drum 3 is rotated at a constant speed in the direction of arrow for formation of a latent image corresponding to the original image on it. The latent image on drum 3 is developed with a toner in developing unit 26 to produce a toner image. The toner image is transferred by the action of transfer unit 27 from drum 3 onto a recording medium fed from cassette 32 by roller 33. After transfer of the toner image, the recording medium is fed by belt 29 to fixing unit 30, in which the toner image corresponding to the original image is fixed on the recording medium. Subsequently, the recording medium is discharged onto tray 31. Drum 3 is then cleaned by cleaning unit 28.

The quantity of light from original illumination lamp 1 noted above is varied automatically according to the image density of the original. More specifically, prior to the original exposure scan a photometric scan is executed by causing forward movement of lamp 1 and mirrors 20 to 22, and the quantity of light from lamp 1 is controlled according to the result of measurement by density sensor 2.

Referring to FIG. 1, designated at 1 is an original illumination lamp, at 2 is a density sensor, at 4 is an optical system, at 6 an A/D converter for converting the output voltage of density sensor 2 to a digital value, at 8 is a D/A converter, at 10 is a RAM for storing detection data of density sensor 2 and so forth, at 11 is a ROM for storing a control procedure shown in FIG. 4, at 12 is a microcomputer undertaking the control of the entire apparatus, at 13 is a control unit, at 19 is a battery for backing up RAM 10, at 14 is an auto/manual density regulation switch, at 15 is a manual density regulation unit, at 16 is a print key, and at 17 is a console.

Now, the operation of the embodiment will be described with reference to the flow chart shown in FIG. 4.

When microcomputer 12 in control unit 13 detects depression of print key 16 (step 1), it checks the selection of the density setting. If manual density setting is selected, exposure scan is started (step 3) without executing photometric scanning. Density data from density sensor 2 during exposure scan is digitized through A/D converter 6, and digital data thus obtained is read into microcomputer 12 (step 4). The density data is stored together with the lamp "on" voltage set by manual density regulation unit 15, and data in RAM 10 representing the "relation between density data and adequate lamp voltage" (FIG. 3), and the "relation between density data and adequate lamp voltage" modified as shown by dashed line in FIG. 3 using the method of least squares or like means (step 5).

When the manual density setting is selected, the "relation between density data and adequate lamp voltage" (FIG. 3) in RAM 10 is always modified progressively in the above way according to the manually set lamp "on" voltage and measured original density data.

When automatic density setting is selected, photometric scan is executed (step 6) prior to exposure scan. More specifically, photometric scan is executed while operating original illumination lamp 1 with a certain predetermined light level by driving optical system driving unit 5, and the quantity of light reflected from the original is measured by density sensor 2. The density data from density sensor 2 at this time is digitized through A/D converter and then read into microcomputer 12 (step 7).

Then, using the modified "relation between density data and adequate lamp voltage" in RAM 10 obtained in the above ways, an adequate lamp voltage is obtained with reference to the density data obtained through the photometric scan (step 8). The lamp voltage thus obtained is provided to lamp regulator 7 (step 9) for exposure scan (step 10), thereby obtaining an adequate density image.

In this embodiment, when a copying operation with manual density setting is performed at a certain frequency, the "relation between density data and adequate lamp voltage" (FIG. 3) follows changes over time in the sensitivity of photosensitive drum 3, changes in sensitivity of density sensor 2, or changes in the lamp illumination intensity. Therefore, when automatic exposure regulation is selected, it is possible to obtain adequate image sensity at all time. In the event of failure of proper automatic exposure regulation function due to the changes noted above, it is forecast that the density setting is switched over to the manual density setting for printing. A consequence is that the "relation between density data and adequate lamp voltage" (FIG. 3) is modified to be suited to the prevailing situation, and proper automatic exposure regulation is restored subsequently.

In this embodiment, RAM 10 is connected to back-up battery 19 as shown in FIG. 1. Therefore, even when the power source for the entire apparatus is lost, the "relation between density data and adequate lamp voltage" (FIG. 3) is not lost.

Figure 5:
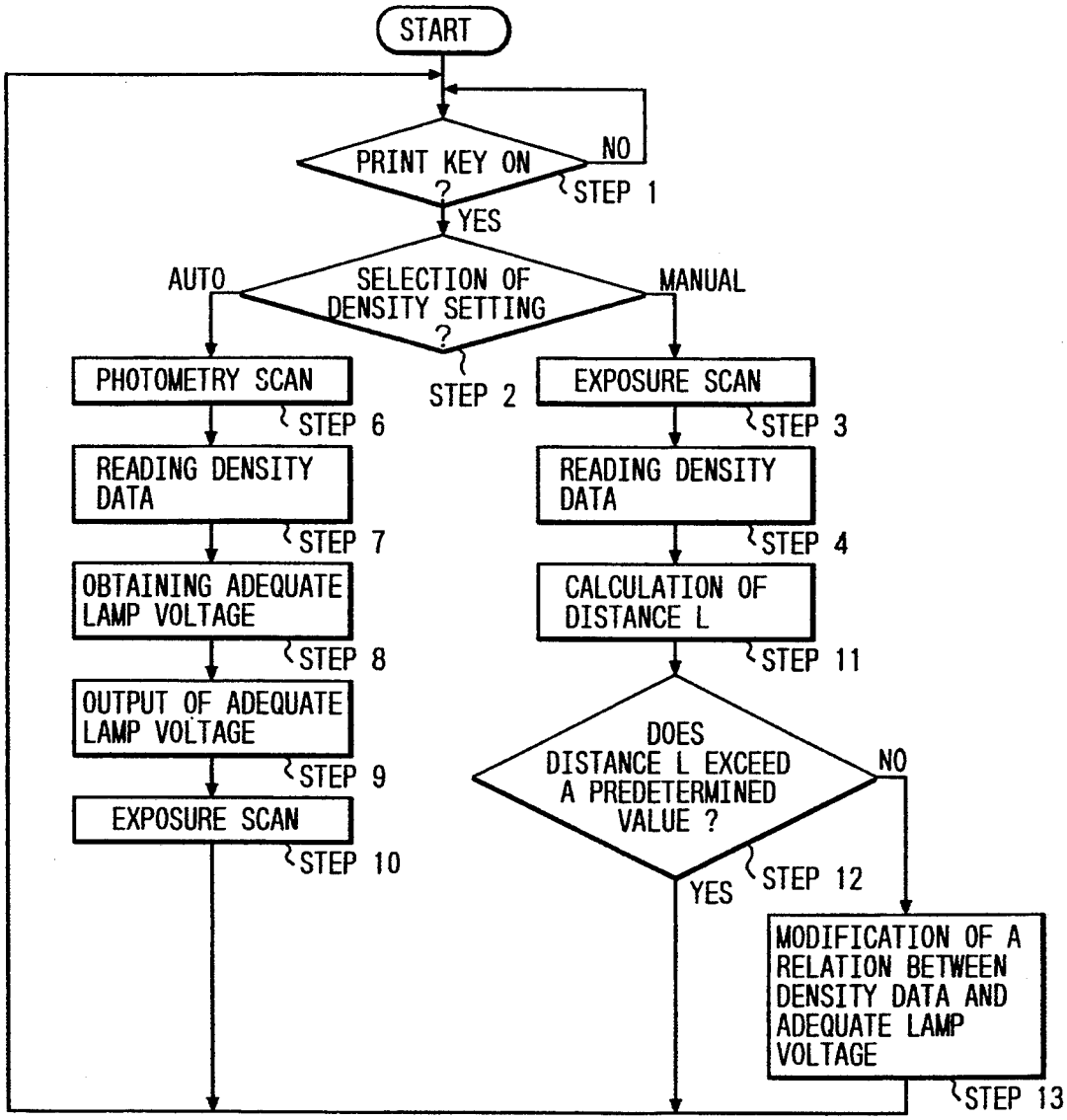

FIG. 5 is a flow chart illustrating a slight improvement of the control procedure shown in FIG. 4. Operation concerning the exposure regulation subsequent to the depression of print key 16 will now be described with reference to this flow chart.

Referring to FIG. 5, when microcomputer 12 in control unit 13 detects depression of print key 16, it checks the selection of density setting. If manual density setting is selected, like the control procedure shown in FIG. 4, exposure scan is started without execution of photometric scan (step 3). Density data from density sensor 2 during the exposure scan is digitized through A/D converter 6 and then read into microcomputer 12 (step 4).

The density data is used together with manually set lamp "on" voltage for calculating distance (L in FIG. 3) with respect to the "relation between density data and adequate lamp voltage" in RAM 10 (step 11). In this example, if distance is above a predetermined value, it is treated as an error sample, and the "relation between density data and adequate lamp voltage" is not modified. If and only if distance L is below a predetermined value, it is stored in addition to the "relation between density data and adequate lamp voltage" (FIG. 3), and the "relation between density data and adequate lamp voltage" (FIG. 3) is modified using the method of least squares or like means (step 13). When automatic density setting is selected, the procedure is the same as in the case of FIG. 4, so it will not be described.

In this example, it is possible to avoid inadequate modification of the "relation between density data and adequate lamp voltage" (FIG. 3) that is otherwise liable in such a case as when printing is performed with manual density setting for the purpose of obtaining a print image with a density which is far from the adequate density or when printing is done by mistake with a density far from the adequate density. The above description of this example is based on the assumption over time changes in the sensitivity of photosensitive drum 3, changes in the sensitivity of density sensor 2, or changes in the lamp illumination intensity are not rapid.

Figure 6:
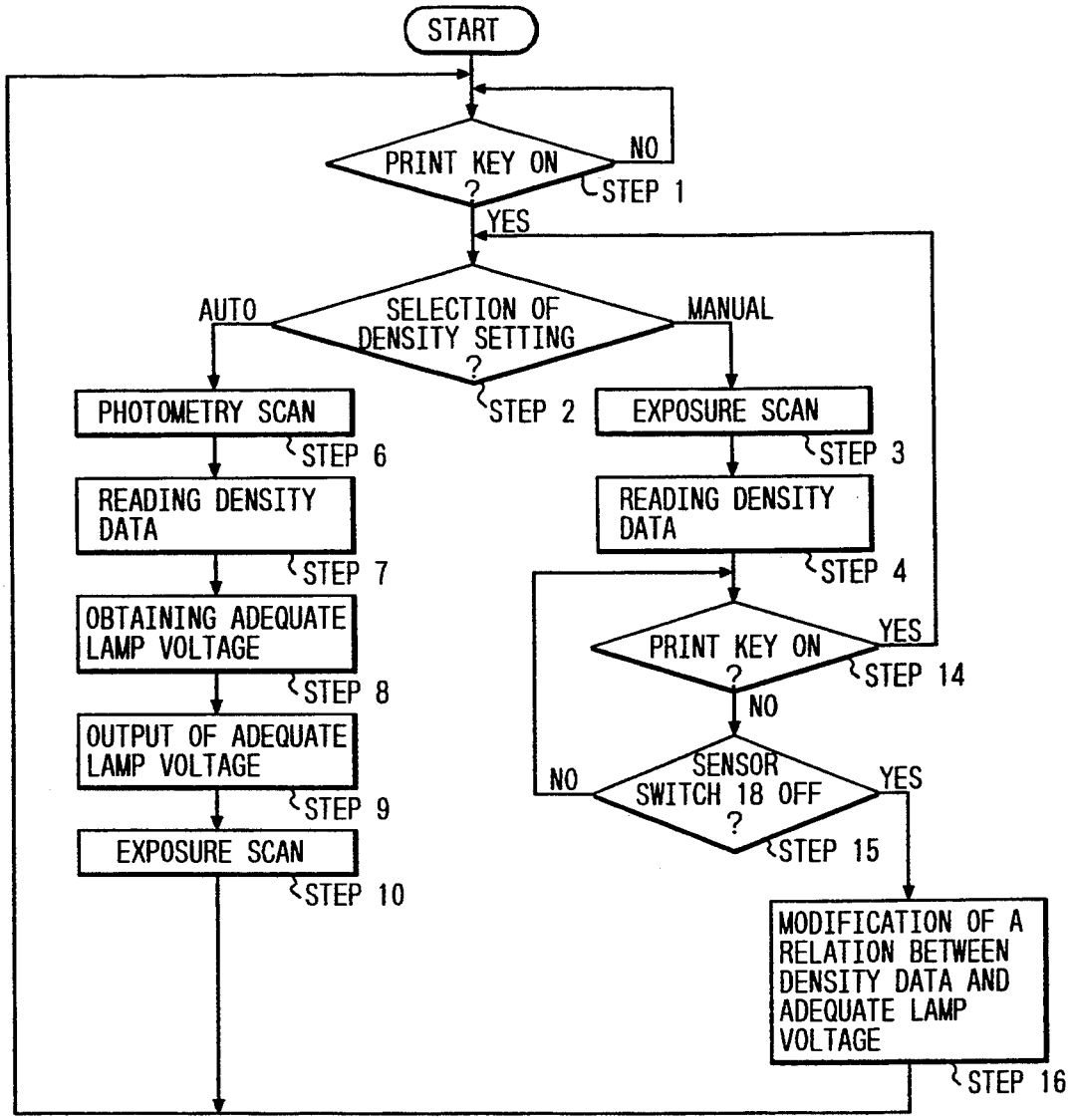

FIG. 6 is a flow chart illustrating a further control procedure. Operation concerning the exposure regulation subsequent to the depression of print key 16 will now be described with reference to this flow chart.

Referring to FIG. 6, when microcomputer 12 detects the depression of print key 16, it checks the selection of density setting. If the manual density setting is selected (step 2), the exposure scan is started without photometric scan (step 3).

Data from density sensor 2 during the exposure scan is digitized through A/D converter 6 and read into microcomputer 12 (step 4). The density data is temporarily stored together with manually set lamp "on" voltage in RAM 10.

In a case when cover base sensor switch 18 is turned off with original base cover 36 opened before depression of print key 16 (steps 14 and 15), the data is stored together with the "relation between density data and adequate lamp voltage" (FIG. 3), and the "relation between density data and adequate lamp voltage" (FIG. 3) is modified by means of the method of least squares (step 16). Further, when print key 18 is depressed afresh before original base cover sensor switch 18 is turned off, the stored data pair at the instant of depression is rendered ineffective, and the procedure goes back to the step right after detection of the print key depression (i.e., step 2). When the automatic density setting is selected, the procedure is the same as in the case of FIG. 4, so it will not be described.

In this example, manual exposure setting is selected by the operator. This is based on the assumption of performing the copying of the same original afresh by selecting the manual density setting once again after failure of obtaining an adequate density image print. This means that in this example the "relation between density data and adequate lamp voltage" (FIG. 3) is modified by using only the data concerning the last print obtained by the operator. Thus, as noted above, it is possible to avoid unnecessary modification of the "relation between density data and adequate lamp voltage" (FIG. 3) with the data in case of failure of obtaining adequate density image print in spite of selection of manual density setting.

In the control procedures shown in the flow charts of FIGS. 4 to 6 described above, the automatic density regulation can follow photosensitive drum sensitivity changes over time, density sensor sensitivity changes over time or changes in the lamp illumination intensity so long as the copying operation by manual density setting is performed at a certain frequency. Also, when it becomes apparent that proper automatic exposure regulation can no longer be obtained due to the changes noted above, it is forecast that the operator switches the density setting to manual density setting for printing. Thus, the automatic density regulation procedure is modified to be suited to the prevailing situation, and proper automatic exposure regulation is subsequently restored.

The above embodiment dealt with the relation between original lamp "on" voltage and density sensor data. However, similar effects can be obtained when a relation between other detection means for detecting the original density, for instance voltage applied to the developing unit, and density sensor data is dealt with.

Further, in a digital copier or facsimile apparatus, in an image is converted to an electric signal for processing, it is possible to adequately modify parameters for determining a threshold level or the like for binarizing the image signal with respect to an original density data.

As has been shown, in the above embodiment there are provided a selection unit for selecting whether manual or automatic original density setting, a density setting unit for setting the density of an original, a sensor unit for setting the density of an original image, a storage unit for storing density data and density setting value and a density control unit for controlling the image density, and manually set value and density data when manual density setting is selected are stored in the storage unit for effecting automatic density setting according to the stored data when the automatic density setting is subsequently selected.

With this arrangement, it is possible to progressively modify image processing parameters concerning density data. More specifically, when manual density setting is selected by the auto-manual density regulation switching unit on the console, an image processing parameter concerning density data is modified using a relation between image density manually set by the operator and density data from the density sensor, and when automatic density regulation is selected, modified parameters are used to permit image processing with adequate density.

Thus, parameters necessary for image formation can be adequately modified according to environment conditions such as ambient temperature changes, thus permitting satisfactory image formation at all time.

While some preferred embodiments of the invention have been described, they are by no means limitative, and various changes and modifications of them may be made without departing from the scope of the invention as claimed in the following claims.

I claim:

1. An image processing apparatus comprising:

sensor means for sensing image density of an original;

setting means for manually setting a desired image density;

determining means for determining an image processing condition, said determining means determining, in a first mode, an image processing condition based on a parameter in correspondence to the image density sensed by said sensor means, and determining, in a second mode, an image processing condition, and determining, in a second mode, an image processing condition based on a parameter in correspondence to an image density set by said setting means;

judging means for automatically judging whether the parameter that is used in said first mode for determining the image processing condition should be modified in accordance with a relation among the image density set in said second mode by said setting means, the image density sensed by said sensor means, and the parameter that is used in said first mode; and modifying means for automatically modifying the parameter that is used in said first mode for determining the image processing condition in accordance with the result of judgment by said judging means.

2. The image processing apparatus according to claim 1, wherein said modifying means modifies said parameter .when the relation between the image density sensed by said sensor means and image density set by said setting means is a predetermined relation.

3. The image processing apparatus according to claim 1, wherein said modifying means modifies said parameter after end of image processing with respect one sheet of original.

4. The image processing apparatus according to claim 1, wherein said image processing condition is the original exposure level.

5. The image processing apparatus according to claim 1, which further comprises selecting means for selecting either said first mode or said second mode.

6. An image processing method comprising the steps of:

sensing an image density of an original;

manually setting a desired image density;

determining an image processing condition, wherein, in a first mode, the image processing condition is determined based on a parameter in correspondence to the image density sensed in said sensing step, and in a second mode, the image processing condition is determined based on a parameter in correspondence to the image density set in said setting step;

automatically judging whether the parameter that is used in the first mode for determining the image processing condition should be modified in accordance with a relation among the image density set in the second mode in said setting step, the image density sensed in said sensing step and the parameter that is used in said first mode; and automatically modifying the parameter that is used in the first mode for determining the image processing condition in accordance with a result of the judgment in said judging step.

7. A method according to claim 6, wherein the parameter is modified when the relation between the image density sensed in said sensing step and the image density set in said setting step is a predetermined relation.

8. A method according to claim 6, wherein the parameter is modified after end of image processing with respect one sheet of original.

9. A method according to claim 6, wherein the image processing condition is an original exposure level.

10. A method according to claim 6, further comprising the step of selecting either the first mode or the second mode.

* * * * *

UNITED STATES PATENT AND TRADEMARK OFFICE

CERTIFICATE OF CORRECTION

PATENT NO. : 5,392,097

DATED : February 21, 1995

INVENTOR(S) : Kazuo Ohtani

It is certified that error appears in the above-identified patent and that said Letters Patent is hereby corrected as shown below:

COVER PAGE

Under [56] References Cited, U.S. Patent Documents, please insert
--4,699,502 10/1987 Araki et al. .... 355/69(XR)--
and
--4,796,060 1/1989 Miyude ..... 355/69(XR)--.

Under [56] References Cited, Foreign Patent Documents, please insert
--137250 6/1988 Japan ..... 355/214--.

COLUMN 1

Line 46, "photosensitivity" should read --photosensitive--.

COLUMN 3

Line 47, "sensity" should read --density-- and "time" should read --times--.

COLUMN 4

Line 55, "key 18" should read --key 16--.

UNITED STATES PATENT AND TRADEMARK OFFICE

CERTIFICATE OF CORRECTION

PATENT NO. : 5,392,097

DATED : February 21, 1995

INVENTOR(S) : Kazuo Ohtani

It is certified that error appears in the above-identified patent and that said Letters Patent is hereby corrected as shown below:

COLUMN 6

Line 10, "condition, and determining, in a second mode" should be deleted; and

Line 11, "an image processing" should be deleted.

Signed and Sealed this

Sixth Day of June, 1995

Bruce Lehman

*Attest:*

BRUCE LEHMAN

*Attesting Officer*

*Commissioner of Patents and Trademarks*